US011523669B2

(12) United States Patent
Bachellier et al.

(10) Patent No.: US 11,523,669 B2
(45) Date of Patent: Dec. 13, 2022

(54) PRODUCTION APPARATUS FOR PRODUCING A COMPOSITION

(71) Applicant: SEB S.A., Ecully (FR)

(72) Inventors: Paul Bachellier, Viry (FR); Olivier Le Grand, Messigny et Vantoux (FR)

(73) Assignee: SEB S.A., Ecully (FR)

( * ) Notice: Subject to any disclaimer, the term of this patent is extended or adjusted under 35 U.S.C. 154(b) by 372 days.

(21) Appl. No.: 16/624,671

(22) PCT Filed: Jun. 20, 2018

(86) PCT No.: PCT/FR2018/051496
§ 371 (c)(1),
(2) Date: Dec. 19, 2019

(87) PCT Pub. No.: WO2018/234700
PCT Pub. Date: Dec. 27, 2018

(65) Prior Publication Data

US 2020/0178670 A1 Jun. 11, 2020

(30) Foreign Application Priority Data

Jun. 23, 2017 (FR) ..... 1755779

(51) Int. Cl.
*B65D 81/32* (2006.01)
*A45D 34/00* (2006.01)
(Continued)

(52) U.S. Cl.
CPC ..... *A45D 34/00* (2013.01); *B01F 35/7131* (2022.01); *A45D 40/24* (2013.01);
(Continued)

(58) Field of Classification Search
CPC ..... B65D 25/082; B65D 51/2857; B65D 51/2864; B65D 81/3277; A45D 34/00;
(Continued)

(56) References Cited

U.S. PATENT DOCUMENTS 2,446,398 A * 8/1948 Charleys ..... A45D 24/24 222/510
4,791,149 A * 12/1988 Pocknell ..... A61L 26/0061 222/145.6
(Continued)

FOREIGN PATENT DOCUMENTS

DE 90 17 592 U1 5/1991
FR 3 026 622 A1 4/2016
(Continued)

OTHER PUBLICATIONS

International Search Report as issued in International Patent Application No. PCT/FR2018/051496, dated Nov. 9, 2018.

*Primary Examiner* — Luan K Bui
(74) *Attorney, Agent, or Firm* — Pillsbury Winthrop Shaw Pittman LLP

(57) ABSTRACT

An apparatus for producing a composition includes a holding device for holding first and second capsules including first and second deformable compartments, respectively, which contain a first formulation and a second formulation, respectively; a first compression element including a first compression surface designed to apply a pressure to the first deformable compartment of the first capsule; and a second compression element including a second compression surface designed to apply a pressure to the second deformable compartment of the second capsule. The first compression surface is designed to conduct and guide the contents of the first capsule to a first passage in the first capsule that can be fluidically connected to the first deformable compartment and the second compression surface is designed to conduct and guide the contents of the second capsule to a second passage in the second capsule that can be fluidically connected to the second deformable compartment.

16 Claims, 6 Drawing Sheets

(51) Int. Cl.

| | |
|---|---|
| ***B01F 35/71*** | (2022.01) |
| *A45D 40/24* | (2006.01) |
| *B01F 35/92* | (2022.01) |
| *B01F 101/21* | (2022.01) |
| *B01F 101/22* | (2022.01) |

(52) U.S. Cl.
CPC ..... *A45D 2200/058* (2013.01); *B01F 35/92* (2022.01); *B01F 2101/21* (2022.01); *B01F 2101/22* (2022.01)

(58) Field of Classification Search
CPC ..... A45D 40/24; A45D 2034/005; A45D 2200/058; B01F 35/7131; B01F 2101/21; B01F 35/92; B01F 2101/22
USPC ..... 206/219–222, 568
See application file for complete search history.

(56) References Cited

U.S. PATENT DOCUMENTS 5,242,082 A * 9/1993 Giannuzzi ..... B05C 17/00506 222/137
5,314,412 A * 5/1994 Rex ..... A61M 5/19 604/82
5,401,169 A * 3/1995 Fleisher ..... A61K 6/90 433/90
5,699,902 A * 12/1997 Sperry ..... B65D 81/3261 206/219
7,934,864 B2 * 5/2011 Heusser ..... B65D 35/28 366/162.3
9,527,106 B2 * 12/2016 Ngu ..... B05C 17/00583

FOREIGN PATENT DOCUMENTS

JP S62-298433 A 12/1987
WO WO 2016/144326 A1 9/2016

* cited by examiner

Fig. 1
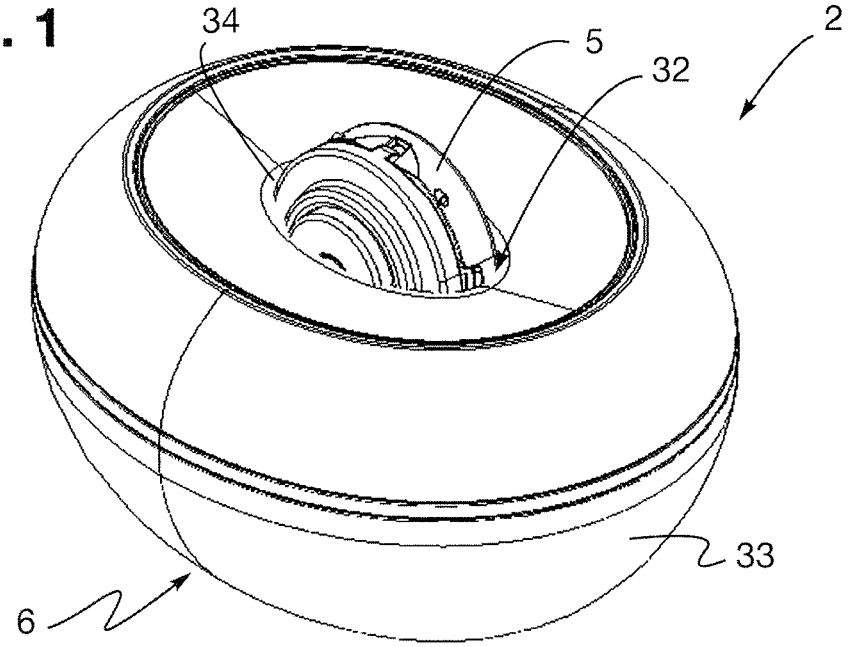
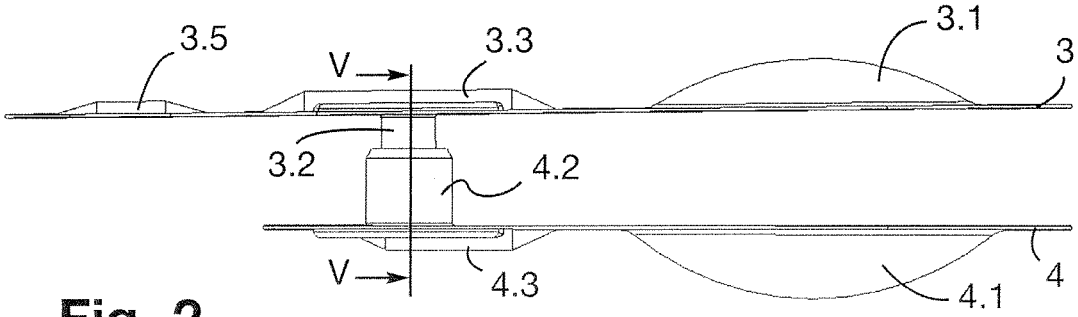
Fig. 2
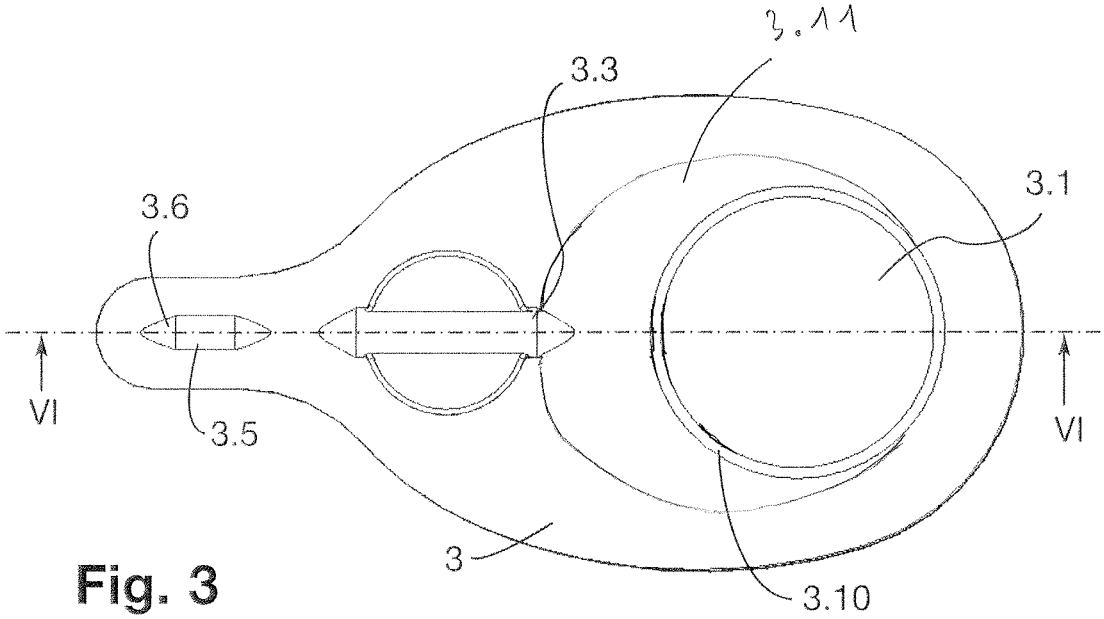
Fig. 3

Fig. 4
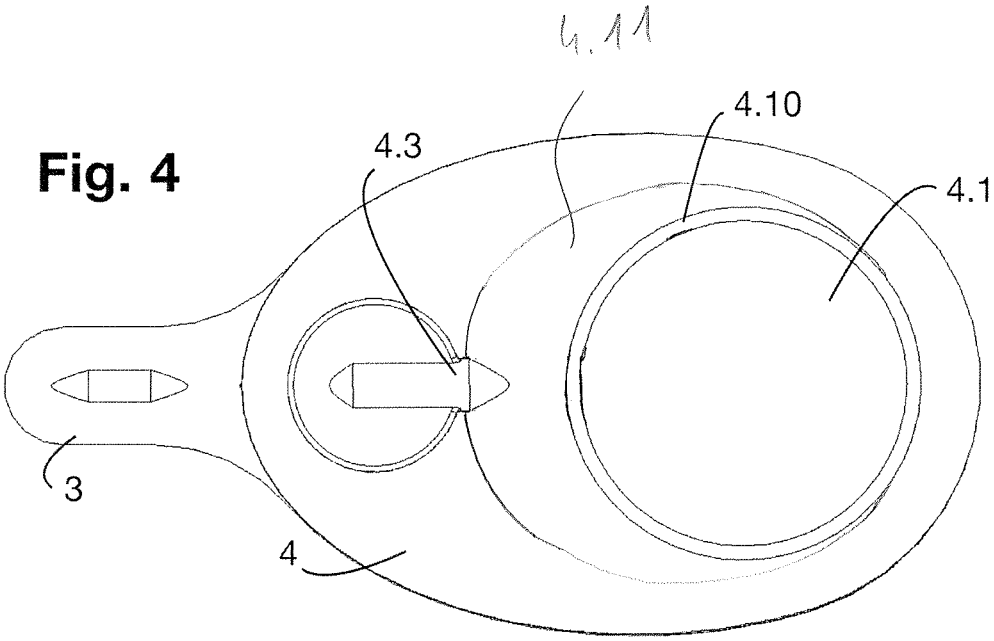
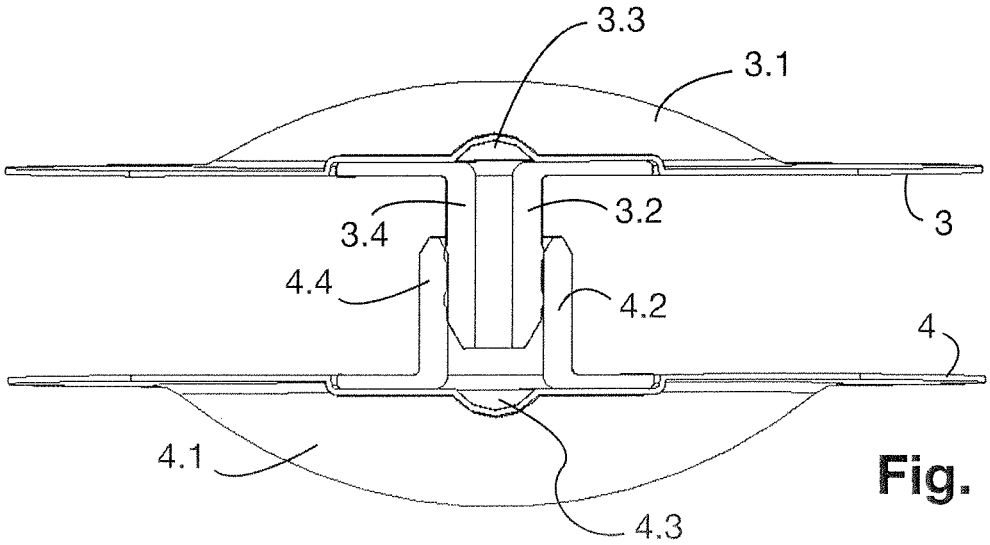
Fig. 5
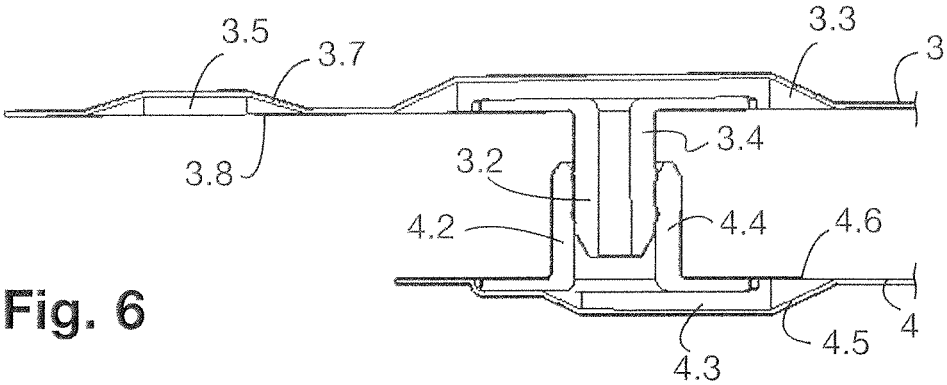
Fig. 6

Fig. 10
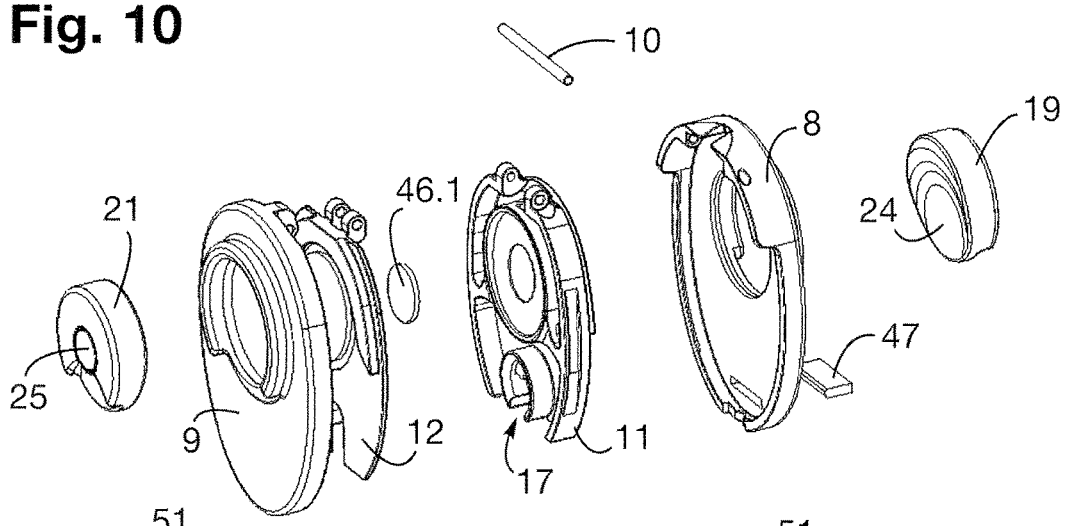
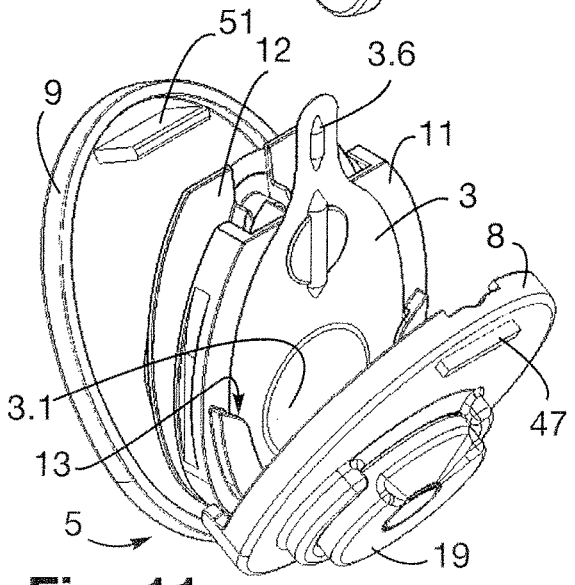
Fig. 11
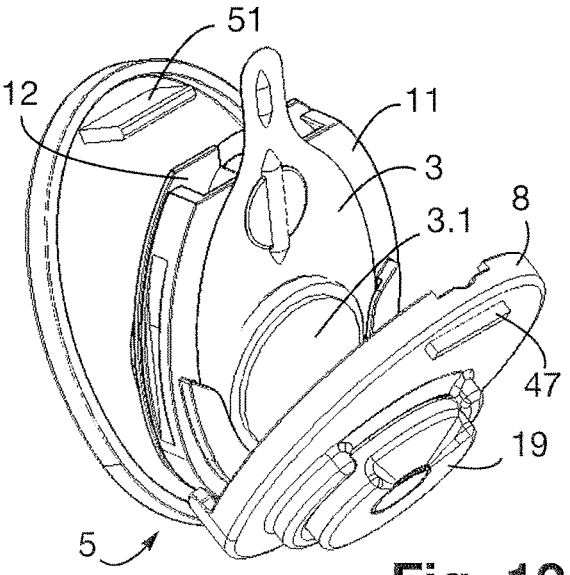
Fig. 12
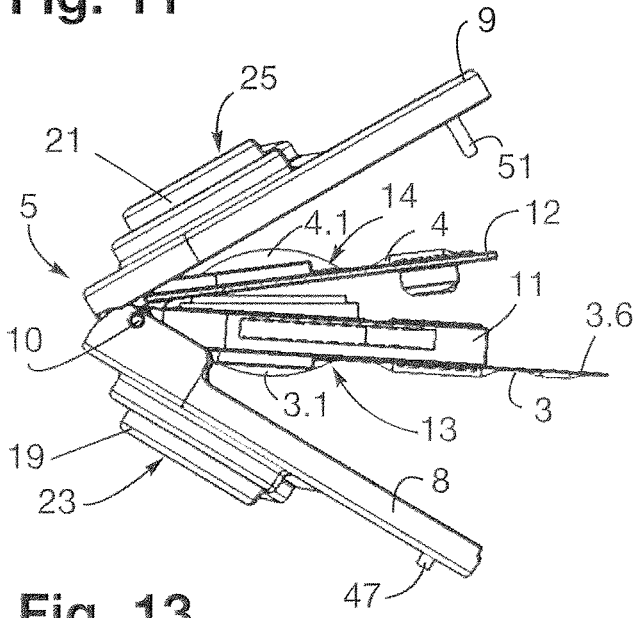
Fig. 13
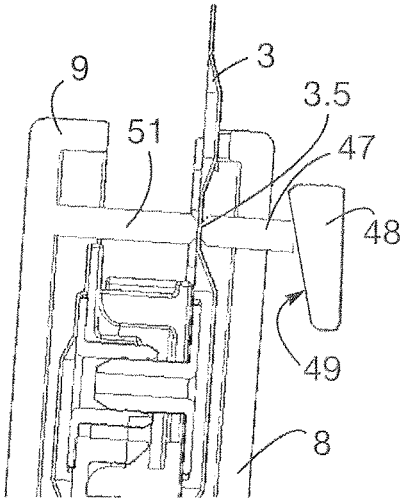
Fig. 14

Fig. 20
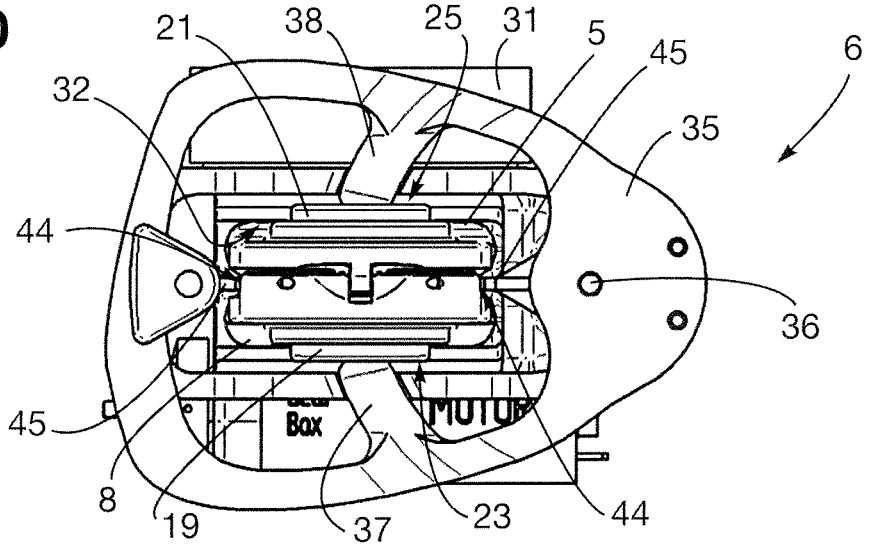
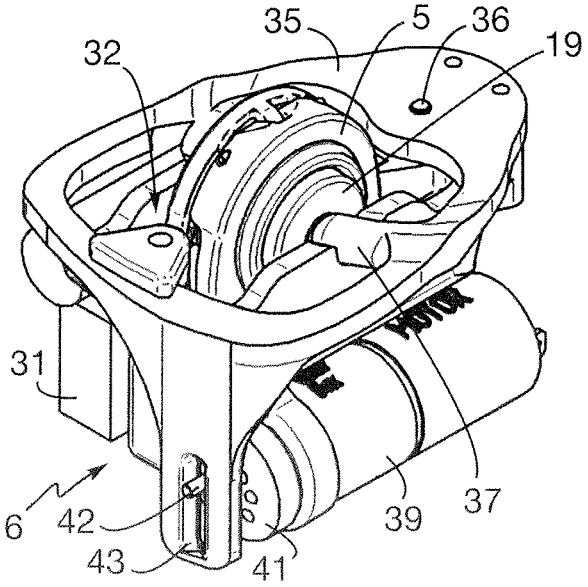
Fig. 21
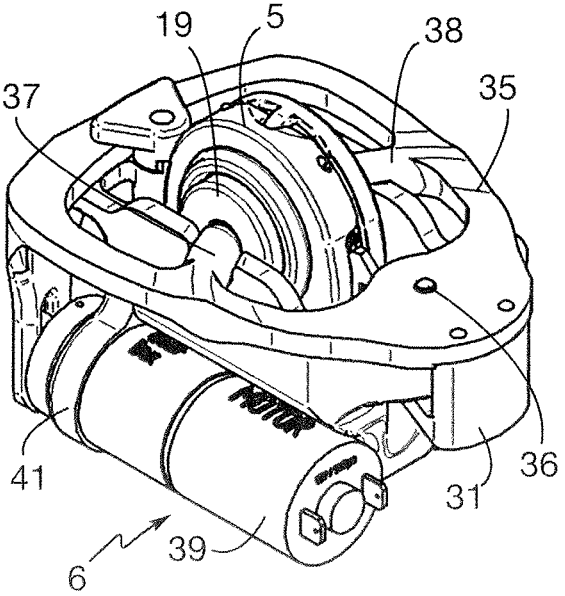
Fig. 22
Fig. 23
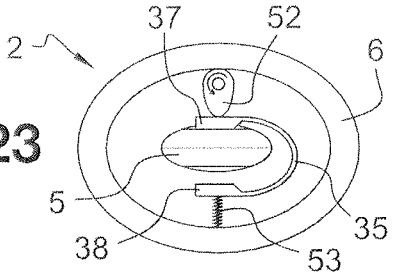
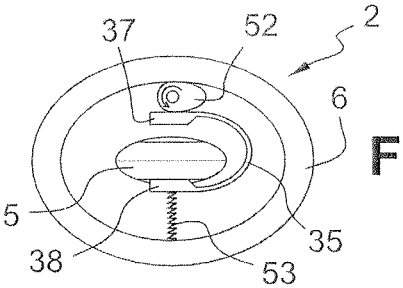
Fig. 24

PRODUCTION APPARATUS FOR PRODUCING A COMPOSITION

CROSS REFERENCE TO RELATED APPLICATIONS

This application is the U.S. National Stage of PCT/FR2018/051496, filed Jun. 20, 2018, which in turn claims priority to French Patent Application No. 1755779 filed Jun. 23, 2017, the entire contents of all applications are incorporated herein by reference in their entireties.

This invention concerns a production apparatus for producing a composition.

The document FR3026622 discloses a production apparatus for producing a composition, and more particularly, a cosmetic product, the production apparatus comprising:

- a first capsule comprising a first compartment containing a predetermined quantity of a first formulation, and a first connecting part,
- a second capsule comprising a second compartment containing a predetermined quantity of a second formulation, and a second connecting part configured to be connected to the first connecting part, and
- a mixing machine configured to receive the first and second capsules, and to mix the first and second formulations directly inside the first and second capsules so as to obtain the cosmetic product.

The mixing machine comprises in particular:

- a first bearing element comprising a first bearing surface configured to apply, on the first deformable compartment of the first capsule, a pressure force which is orthogonal to the direction of movement of the first bearing element,
- a second bearing element comprising a second bearing surface configured to apply, on the second deformable compartment of the second capsule, a pressure force which is orthogonal to the direction of movement of the second bearing element, and
- a drive motor mechanically connected to the first and second bearing elements, and configured to allow cyclical movement of the first and second bearing elements between inactive and active positions.

Such a production apparatus makes it possible for an end user to produce a personalized cosmetic product from different capsules.

However, the structure of the production apparatus described in the document FR3026622 necessitates a large drive motor in order to transmit, to the first and second deformable compartments, pressure forces suitable for ensuring that the contents of the first compartment migrate to the second compartment, and conversely that the contents of the second compartment migrate to the first compartment, in particular when the first and second deformable compartments or connecting channels associated with the first and second deformable compartments are closed by areas with weak seams.

Providing for a large drive motor substantially increases the manufacturing costs of the production apparatus. as well as the volume and weight of the latter.

This invention aims to remedy all or a portion of these disadvantages.

The technical problem at the base of the invention consists of providing a composition production apparatus that is simple, compact and easy to use, and has a simple structure and a low price.

For this purpose, this invention concerns a production apparatus for producing a composition, comprising:

- a receiving device configured to receive first and second capsules comprising, respectively, first and second deformable compartments containing, respectively, a first formulation and a second formulation,
- a first bearing element comprising a first bearing surface configured to apply a pressure force on the first deformable compartment of the first capsule when the first capsule is received in the receiving device, and
- a second bearing element comprising a second bearing surface configured to apply a pressure force on the second deformable compartment of the second capsule when the second capsule is received in the receiving device, characterized in that the first bearing surface is configured to conduct and guide the contents of the first capsule toward a first connecting passage of the first capsule which is able to be fluidically connected to the first deformable compartment, when the first bearing surface applies a pressure force on the first deformable compartment, and in that the second bearing surface is configured to conduct and guide the contents of the second capsule toward a second connecting passage of the second capsule which is able to be fluidically connected to the second deformable compartment, when the second bearing surface applies a pressure force on the second deformable compartment.

A "bearing surface configured to conduct and guide the contents of the capsule toward a connecting passage" is understood to mean a bearing surface presenting a shape such that the force vector applied by the bearing surface on the capsule presents a positive, non-zero component in the direction of the connecting passage.

Thus, the force applied by the bearing surface tends, by itself, to push the contents of the capsule back in the direction of the connecting passage.

Such a configuration of the production apparatus, and more particularly of the first and second bearing surfaces, substantially reduces the pressure forces that must be applied on the first and second deformable compartments in order to ensure that the contents of the first and second deformable compartments are drained from the latter.

Consequently, the production apparatus according to the invention allows the use of a smaller motor in comparison with the production apparatuses of prior art, and thus in particular it substantially reduces the manufacturing costs of the production apparatus and substantially increases its compactness and reduces its electricity consumption.

The production apparatus may in addition have one or more of the following characteristics, taken alone or in combination.

According to one embodiment of the invention, the first bearing surface is configured to conduct and guide the contents of the first capsule toward a first fluid inlet of the first connecting passage facing the first deformable compartment, when the first bearing surface applies a pressure force on the first deformable compartment, and the second bearing surface is configured to conduct and guide the contents of the second capsule toward a second fluid inlet of the second connecting passage, when the second bearing surface applies a pressure force on the second deformable compartment.

According to one embodiment of the invention, the first bearing element is able to move between an inactive position and an active position, in which the first bearing surface is able to apply a pressure force on the first deformable compartment of the first capsule, and the second bearing element is able to move between an inactive position and an active position, in which the second bearing surface is able to apply a pressure force on the second deformable compartment of the second capsule.

Advantageously, the inactive position of the first bearing element corresponds to a position of the first bearing element in which, when the receiving device is equipped with the first and second capsules:

- the first bearing element is situated at a distance from the first capsule, and more particularly from the first deformable compartment, or
- the first bearing element is in contact only with the first capsule, and more particularly with the first deformable compartment, or
- the first bearing element applies a pressure force on the first capsule, and more particularly on the first deformable compartment, which is insufficient to make the contents of the first deformable compartment migrate toward the second capsule.

Advantageously, the inactive position of the second bearing element corresponds to a position of the second bearing element in which, when the receiving device is equipped with the first and second capsules:

- the second bearing element is situated at a distance from the second capsule, and more particularly from the second deformable compartment, or
- the second bearing element is in contact only with the second capsule, and more particularly with the second deformable compartment, or
- the second bearing element applies a pressure force on the second capsule, and more particularly on the second deformable compartment, which is insufficient to make the contents of the second deformable compartment migrate toward the first capsule.

Advantageously, the active position of the first bearing element corresponds to a position of the first bearing element in which, when the receiving device is equipped with the first and second capsules, the first bearing element applies a pressure force on the first capsule, and more particularly on the first deformable compartment, which is sufficient to make the contents of the first deformable compartment migrate toward the second capsule, and the active position of the second bearing element corresponds to a position of the second bearing element in which, when the receiving device is equipped with the first and second capsules, the second bearing element applies a pressure force on the second capsule, and more particularly on the second deformable compartment, which is sufficient to make the contents of the second deformable compartment migrate toward the first capsule.

According to one embodiment of the invention, the first bearing element is able to move according to a first direction of movement, and the second bearing element is able to move according to a second direction of movement.

According to one embodiment of the invention, when the first bearing element is moved from the inactive position to the active position, the first bearing surface is configured to apply a pressure force successively on a first portion of the first deformable compartment situated at a first primary distance from the first connecting passage and on a second portion of the first deformable compartment situated at a second primary distance from the first connecting passage, the second primary distance being smaller than the first primary distance, and in which, when the second bearing element is moved from the inactive position to the active position, the second bearing surface is configured to apply a pressure force successively on a first portion of the second deformable compartment situated at a first secondary distance from the second connecting passage and on a second portion of the second deformable compartment situated at a second secondary distance from the second connecting passage, the second secondary distance being smaller than the first secondary distance. These provisions ensure, respectively, that the contents of the first deformable compartment are conducted optimally toward the first connecting passage, and that the contents of the second deformable compartment are conducted optimally toward the second connecting passage, and thus further reduce the size of the motor used to drive the first and second bearing elements.

According to one embodiment of the invention, the first bearing surface comprises a first primary surface portion configured to apply a pressure force on the first portion of the first deformable compartment, and a second primary surface portion configured to apply a pressure force on the second portion of the first deformable compartment, and the second bearing surface comprises a first secondary surface portion configured to apply a pressure force on the first portion of the second deformable compartment, and a second secondary surface portion configured to apply a pressure force on the second portion of the second deformable compartment.

According to one embodiment of the invention, the first primary surface portion is configured to apply a pressure force on the first portion of the first deformable compartment which is oriented obliquely with respect to the first direction of movement and substantially toward the first connecting passage, and the first secondary surface portion is configured to apply a pressure force on the first portion of the second deformable compartment which is oriented obliquely with respect to the second direction of movement and substantially toward the second connecting passage.

According to one embodiment of the invention, the first primary surface portion is configured to apply a pressure force on at least one peripheral part of the first deformable compartment which is opposite the first connecting passage, and the first secondary surface portion is configured to apply a pressure force on at least one peripheral part of the second deformable compartment which is opposite the second connecting passage. Such a characteristic both permits a firm hold on the peripheral part of each deformable compartment and reinforces its tightness by preventing any seam at the edge of the peripheral part from being subjected to fluid pressure.

According to one embodiment of the invention, the first bearing element comprises a first protuberance defining the first primary surface portion, and the second bearing element comprises a second protuberance defining the first secondary surface portion.

According to one embodiment of the invention, both the first and second protuberances extend substantially in a circular arc.

According to one embodiment of the invention, the second primary surface portion is configured to apply a pressure force on the second portion of the first deformable compartment which is oriented substantially parallel to the first direction of movement or which is oriented obliquely with respect to the first direction of movement, and substantially toward the first connecting passage, and the second secondary surface portion is configured to apply a pressure force on the second portion of the second deformable compartment which is oriented substantially parallel to the second direction of movement or which is oriented obliquely with respect to the second direction of movement and substantially toward the second connecting passage.

According to one embodiment of the invention, the first and second primary surface portions are configured such that, when the first bearing element is moved from the inactive position to the active position, the first primary surface portion applies a pressure force on the first portion of the first deformable compartment before the second primary surface portion applies a pressure force on the second portion of the first deformable compartment, and the first and second secondary surface portions are configured such that, when the second bearing element is moved from the inactive position to the active position, the first secondary surface portion applies a pressure force on the first portion of the second deformable compartment before the second secondary surface portion applies a pressure force on the second portion of the second deformable compartment.

According to one embodiment of the invention, the second primary surface portion is configured to apply a pressure force on at least one central part of the first deformable compartment, and the second secondary surface portion is configured to apply a pressure force on at least one central part of the second deformable compartment.

According to one embodiment of the invention, both the second primary surface portion and the second secondary surface portion are substantially flat.

According to one embodiment of the invention, the receiving device comprises the first and second bearing elements.

According to one embodiment of the invention, the receiving device is configured to occupy an open position, in which the first and second capsules are able to be inserted into the receiving device, and a closed position, in which the receiving device is able to hold the first and second capsules in position.

According to one embodiment of the invention, the first direction of movement is substantially orthogonal to the extension plane of the first capsule when the receiving device equipped with the first and second capsules is in the closed position, and the second direction of movement is substantially orthogonal to the extension plane of the second capsule when the receiving device equipped with the first and second capsules is in the closed position.

According to one embodiment of the invention, the first and second directions of movement are substantially parallel.

According to one embodiment of the invention, the receiving device is in addition configured such that a movement of the receiving device equipped with the first and second capsules from the open position to the closed position causes the first and second capsules to connect, and more particularly causes the first and second connecting parts of the first and second capsules to connect.

According to one embodiment of the invention, the production apparatus further comprises a mixing machine configured to receive the receiving device equipped with the first and second capsules, and to mix the first and second formulations contained in the first and second capsules so as to obtain the composition.

According to one embodiment of the invention, the mixing machine comprises a first actuating member configured to transmit a pressure force to the first bearing element so as to make the contents of the first capsule migrate to the second capsule when the receiving device equipped with the first and second capsules is received in the mixing machine, and a second actuating member configured to transmit a pressure force to the second bearing element so as to make the contents of the second capsule migrate into the first capsule when the receiving device equipped with the first and second capsules is received in the mixing machine.

According to one embodiment of the invention, the first and second actuating members are configured to transmit alternatively pressure forces to the first and second bearing elements, respectively.

According to one embodiment of the invention, the first and second actuating members are configured to be arranged on both sides of the receiving device when the receiving device is received in the mixing machine.

According to one embodiment of the invention, the first and second actuating members are arranged opposite one another.

According to one embodiment of the invention, the mixing machine comprises:

an actuating part comprising the first and second actuating members, the actuating part being mounted such that it can pivot about a pivot axis, and a drive motor configured to make the actuating part pivot about the pivot axis, and alternatively in a first pivot direction and in a second pivot direction opposite the first pivot direction.

According to one embodiment of the invention, the drive motor is configured to make the actuating part pivot about the pivot axis and in a predetermined angular range.

According to one embodiment of the invention, the first and second actuating members converge opposite the pivot axis.

According to one embodiment of the invention, the mixing machine is configured such that a rotation of the drive motor in a first direction of rotation results in a pivoting of the actuating part in the first pivot direction, and that a rotation of the drive motor in a second direction of rotation, opposite the first direction of rotation, results in a pivoting of the actuating part in the second pivot direction.

According to another embodiment of the invention, the mixing machine further comprises a drive wheel non-rotatably fixed with respect to an output shaft of the drive motor and configured to be driven in rotation about its wheel axis by the drive motor, the drive wheel being equipped with a drive element, such as a catch pin, off center in relation to the wheel axis, and the actuating part comprises a receiving opening which is elongated and in which the drive element is received.

According to one embodiment of the invention, the receiving opening extends along a direction of extension substantially parallel to the pivot axis.

According to one embodiment of the invention, the first bearing element comprises a first actuating surface opposite the first bearing surface, and the second bearing element comprises a second actuating surface opposite the second bearing surface, the first and second actuating members being configured to apply pressure forces on the first and second actuating surfaces, respectively. Advantageously, both the first and the second actuating surfaces are accessible from outside the receiving device.

According to one embodiment of the invention, the receiving device comprises a first protective shell and a second protective shell mounted such that they can move with respect to one another between a first position, corresponding to the open position of the receiving device, and a second position, corresponding to the closed position of the receiving device.

According to one embodiment of the invention, the first bearing element extends through a first through opening provided on the first protective shell, and the second bearing element extends through a second through opening provided on the second protective shell.

According to one embodiment of the invention, the first and second protective shells are hingedly mounted with respect to one another about a first joint axis.

According to one embodiment of the invention, the first and second bearing elements are mounted on the first and second protective shells, respectively.

According to one embodiment of the invention, the receiving device is configured such that, when the receiving device equipped with the first and second capsules is in the closed position, an orthogonal projection of the first capsule on a reference plane is at least partially aligned with an orthogonal projection of the second capsule on the reference plane. Advantageously, the receiving device is configured such that, when the receiving device equipped with the first and second capsules is in the closed position, an orthogonal projection from a first deformable compartment of the first capsule on the reference plane is at least partially aligned with an orthogonal projection from a second deformable compartment of the second capsule on the reference plane.

According to one embodiment of the invention, the receiving device is configured such that, when the receiving device equipped with the first and second capsules is in the closed position, the first and second capsules extend substantially parallel to one another.

According to one embodiment of the invention, the receiving device comprises a first receiving location configured to receive the first capsule and a second receiving location configured to receive the second capsule.

According to one embodiment of the invention, the receiving device comprises a first support part comprising the first receiving location and a second support part comprising the second receiving location, the first and second support parts being able to move with respect to one another between a receiving position, in which the first and second support parts are separated from one another and the first and second capsules are able to be received in the first and second receiving locations, respectively, and a connecting position in which the first and second support parts are close to one another and the first and second capsules are able to be connected to one another.

According to one embodiment of the invention, the first and second support parts are configured to be moved to the connecting position when the receiving device is moved to the closed position.

According to one embodiment of the invention, the first and second support parts are hingedly mounted with respect to one another about a second joint axis.

According to one embodiment of the invention, the first and second protective shells and the first and second support parts are hingedly mounted about the same joint axis. Thus, the first and second joint axes may be aligned.

According to one embodiment of the invention, the first receiving location comprises a first receiving groove configured to receive at least a portion of the first capsule, and the second receiving location comprises a second receiving groove configured to receive at least a portion of the second capsule.

Advantageously, both the first and second receiving grooves are substantially arched. Advantageously, both the first and second receiving grooves are configured to cooperate with a peripheral edge of a respective first and second capsule.

According to one embodiment of the invention, the first support part comprises a first foolproofing element, such as a first foolproofing notch, configured to cooperate with the first capsule and, for example, with a first connecting part belonging to the first capsule, and the second support part comprises a second foolproofing element, such as a second foolproofing notch, configured to cooperate with the second capsule and, for example, with a second connecting part belonging to the second capsule.

According to one embodiment of the invention, the mixing machine is configured to mix the first and second formulations inside the first and second capsules. Such a configuration makes it possible at least to avoid contact between the mixing machine and the first and second formulations, and thus to avoid a subsequent cleaning of the mixing machine after producing the composition.

According to one embodiment of the invention, the production apparatus comprises a heating element configured to heat at least one of the first and second capsules when the receiving device equipped with the first and second capsules is received in the mixing machine.

According to one embodiment of the invention, the heating element is configured to heat the first capsule. Advantageously, the heating element is configured to extend along an outer surface of the first capsule.

According to one embodiment of the invention, the heating element is arranged in the receiving device or in the mixing machine.

According to one embodiment of the invention, the heating element is configured to extend between the first and second capsules.

According to one embodiment of the invention, the heating element is arranged inside the mixing machine and is configured to extend between the first and second capsules when the receiving device equipped with the first and second capsules is received in the mixing machine.

According to another embodiment of the invention, the heating element is arranged inside the receiving device and is configured to extend between the first and second capsules when the first and second capsules are received in the receiving device.

According to one embodiment of the invention, the receiving device comprises at least one primary guide element, such as a guide groove, configured to cooperate with at least one secondary guide element, such as a guide pin, provided on the mixing machine, when the receiving device is received in the mixing machine.

According to one embodiment of the invention, the receiving device comprises a locking element configured to lock the receiving device in the closed position.

According to one embodiment of the invention, the locking element is able to move between a locking position, in which the locking element locks the receiving device in the closed position, and an unlocking position, in which the locking element allows the receiving device to be moved to the open position.

According to one embodiment of the invention, the receiving device comprises a releasing element, such as a release button, configured to move the locking element to the unlocking position.

According to one embodiment of the invention, the mixing machine comprises a receiving housing configured to receive at least in part the receiving device.

According to one embodiment of the invention, the mixing machine and the receiving device are configured such that the receiving device extends at least in part outside of the mixing machine when the receiving device is received in the receiving housing.

According to one embodiment of the invention, the mixing machine comprises an insertion opening leading to the receiving housing, the receiving device being configured to be inserted into the receiving housing through the insertion opening. Advantageously, the insertion opening is configured to face up when the mixing machine is arranged on a flat support.

According to one embodiment of the invention, the mixing machine comprises a base having an upper surface on which the insertion opening is arranged.

According to one embodiment of the invention, the receiving housing is situated in a central area of the base.

According to one embodiment of the invention, the mixing machine comprises an electrical power source configured to electrically power the mixing machine. Advantageously, the electrical power source comprises at least one rechargeable battery.

According to one embodiment of the invention, the electrical power source is configured to electrically power the receiving device when the receiving device is received in the mixing machine.

According to one embodiment of the invention, the mixing machine comprises a first electrical connector, and the receiving device comprises a second electrical connector configured to be connected to the first electrical connector when the receiving device is received in the mixing machine, such that the mixing machine is able to electrically power the receiving device.

According to one embodiment of the invention, the production apparatus is configured to automatically seal an outlet passage of the first capsule when the receiving device equipped with the first and second capsules is received in the mixing machine, and to automatically release the outlet passage when the receiving device equipped with the first and second capsules is removed from the mixing machine. In other words, the production apparatus is configured to automatically seal the outlet passage concomitantly with the insertion of the receiving device equipped with the first and second capsules in the mixing machine, and to automatically release the outlet passage concomitantly with the removal of the receiving device equipped with the first and second capsules from the mixing machine.

According to one embodiment of the invention, the production apparatus comprises a sealing element configured to automatically seal the outlet passage when the receiving device equipped with the first and second capsules is received in the mixing machine, and to automatically release the outlet passage when the receiving device equipped with the first and second capsules is removed from the mixing machine. Advantageously, the receiving device comprises the sealing element.

According to one embodiment of the invention, the sealing element is configured to pinch the outlet passage or to apply pressure on the outlet passage.

According to one embodiment of the invention, the sealing element is mounted such that it can move between a sealing position, in which the sealing element is able to seal the outlet passage and, for example, able to pinch the outlet passage or apply pressure to the outlet passage, and a releasing position, in which the sealing element is able to release the outlet passage. Advantageously, the sealing element is mounted such that it can move on the first protective shell.

According to one embodiment of the invention, the mixing machine comprises a movement element configured to move the sealing element to the sealing position when the receiving device is inserted into the mixing machine.

According to one embodiment of the invention, the production apparatus comprises a counter-bearing element configured to lean against the first capsule and to be arranged opposite the sealing element when the receiving device equipped with the first and second capsules is received in the mixing machine.

According to one embodiment of the invention, the receiving device comprises the counter-bearing element. Advantageously, the counter-bearing element is provided on the second protective shell.

According to one embodiment of the invention, the receiving device is configured such that the first capsule extends at least in part outside of the receiving device when the first capsule is received in the receiving device. Advantageously, the receiving device is configured such that an outlet orifice of the first capsule extends outside of the receiving device when the first capsule is received in the receiving device.

According to one embodiment of the invention, the receiving device comprises a receiving enclosure configured to receive and house at least in part the first and second capsules.

According to one embodiment of the invention, the composition to be produced is chosen from the group including a cosmetic product, a pharmaceutical product, a haircare product, a perfume, a paint, a plant-protection product, a maintenance product, a cleaning product, an adhesive and an agrifood product.

According to one embodiment of the invention, the production apparatus further comprises a first capsule comprising a first deformable compartment containing a first formulation, and a second capsule comprising a second deformable compartment containing a second formulation.

According to one embodiment of the invention, the first capsule comprises a first connecting part, and the second capsule comprises a second connecting part configured to be connected to the first connecting part.

According to one embodiment of the invention, the first connecting passage is configured to fluidically connect the first deformable compartment and the second connecting part, and the second connecting passage is configured to fluidically connect the second deformable compartment and the second connecting part.

According to one embodiment of the invention, the first formulation is a first phase of a cosmetic product to be produced, and the second formulation is a second phase of the cosmetic product. Advantageously, the first formulation is a fatty phase of the cosmetic product, and the second formulation is an aqueous phase of the cosmetic product. For example, the fatty phase constitutes the base of the cosmetic product, and the aqueous phase includes active elements and constitutes the complex of active ingredients of the cosmetic product to be produced.

According to one embodiment of the invention, the cosmetic product produced is a homogenized emulsion, a homogenized solution or a mixture of several miscible phases.

At any rate, the invention will be understood with the assistance of the following description in reference to the attached schematic drawings representing, as non-restrictive examples, several forms of execution of this production apparatus.

FIG. 1 is a perspective view of a production apparatus according to a first embodiment of the invention.

FIG. 2 is a side view of a first capsule and of a second capsule connected to one another and belonging to the production apparatus in FIG. 1.

FIGS. 3 and 4 are, respectively, top views of the first and second capsules in FIG. 2.

FIG. 5 is a cross-sectional view along the line V-V in FIG. 2.

FIG. 6 is a partial cross-sectional view along the line VI-VI in FIG. 3.

FIGS. 9 and 10 are exploded perspective views of the receiving device in FIG. 7.

FIGS. 11 and 12 are perspective views of the receiving device in FIG. 7 equipped with the first and second capsules, showing first and second support parts in an insertion position and in a connecting position, respectively.

FIG. 13 is a side view of the receiving device in FIG. 7 equipped with the first and second capsules.

FIG. 14 is an enlarged-scale view showing the cooperation of the first capsule with a counter-bearing element and a sealing element provided on the receiving device.

FIG. 20 is a partial top view of the production apparatus in FIG. 1.

FIGS. 21 and 22 are partial perspective views of the production apparatus in FIG. 1.

FIGS. 23 and 24 are schematic top views of a production apparatus according to a second embodiment of the invention.

Figure 7:
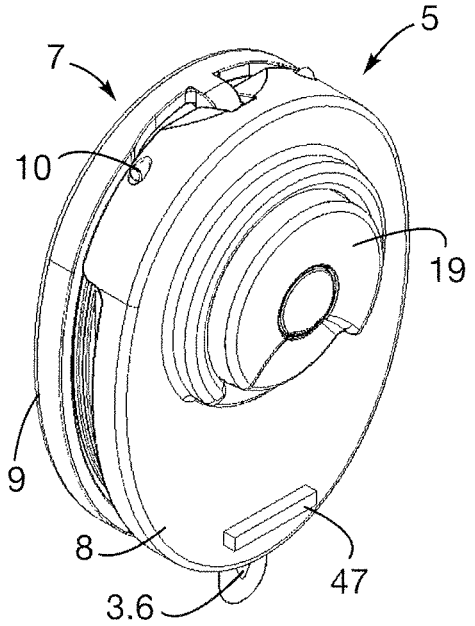
FIG. 7 is a perspective view of a receiving device belonging to the production apparatus in FIG. 1, showing the receiving device in the closed position.
Figure 8:
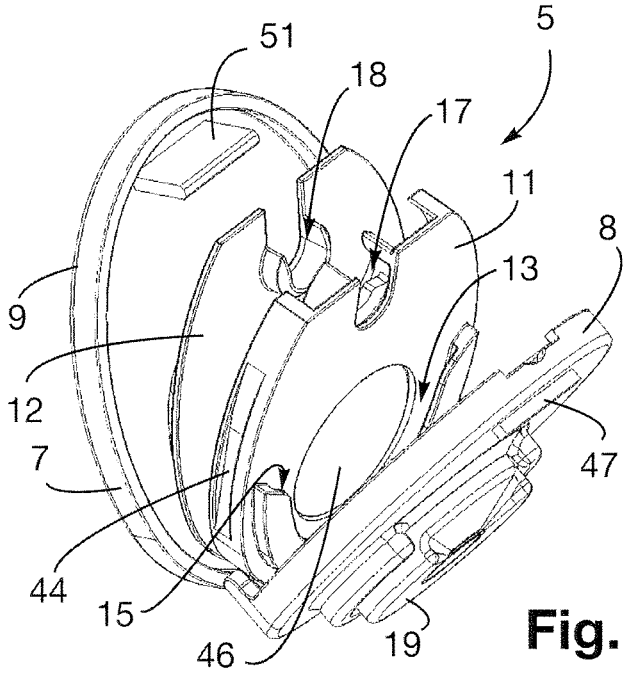
FIG. 8 is a perspective view of the receiving device in FIG. 7, in the open position, the receiving device being represented in the reverse position compared to the position illustrated in FIG. 7.

FIGS. 1 to 22 represent a production apparatus 2, according to a first embodiment of the invention, configured to produce a composition, which may, for example, be a cosmetic product, a haircare product, a pharmaceutical product, a plant-protection product, a maintenance product, a cleaning product, or an agrifood product. When the composition to be produced is a cosmetic product, the latter may, for example, be a homogenized emulsion, a homogenized solution or a mixture of several miscible phases.

The production apparatus 2 comprises in particular first and second capsules 3, 4, also called pods or packing units, containing, respectively, a predetermined quantity of a first formulation and a predetermined quantity of a second formulation, a receiving device 5 configured to receive the first and second capsules 3, 4, and a mixing machine 6 configured to receive the receiving device 5 equipped with the first and second capsules 3, 4, and to mix the first and second formulations contained in the first and second capsules 3, 4 so as to obtain a cosmetic product. Advantageously, the mixing machine 6 is configured to mix the first and second formulations inside the receiving device 5, and preferably inside the first and second capsules 3, 4.

Advantageously, the first formulation is a first phase of a cosmetic product to be produced, such as a fatty phase of a cosmetic product, while the second formulation is a second phase of the cosmetic product, such as an aqueous phase of the cosmetic product. For example, the fatty phase may constitute the base of the cosmetic product to be produced, and the aqueous phase may include active elements and thus constitute a complex of active ingredients of the cosmetic product to be produced.

As shown more particularly in FIGS. 2 to 6, the first and second capsules 3, 4 are separate from one another, and are configured to be connected fluidically to one another. In addition, both the first and second capsules 3, 4 are advantageously single-dose.

The first capsule 3 comprises a first deformable compartment 3.1 containing the first formulation, a first connecting part 3.2 and a first connecting passage 3.3 configured to fluidically connect the first deformable compartment 3.1 and the first connecting part 3.2. Advantageously, the first connecting passage 3.3 is formed by a first connecting channel, and the first connecting part 3.2 extends substantially perpendicularly with respect to the first connecting passage 3.3. The first connecting part 3.2 comprises more particularly a male connecting end 3.4, which may, for example, have a cylindrical shape, fluidically connected to the first connecting passage 3.3.

According to the embodiment represented in the figures, the first deformable compartment 3.1 comprises a first frangible peripheral area 3.10, presenting one or more frangible portions, also called weakening portions, configured to break when sufficient mechanical pressure is applied to the first deformable compartment 3.1.

Advantageously, the first capsule 3 also comprises a first buffer area 3.11 extending at least in part around the first peripheral area 3.10 of the first deformable compartment 3.1, and the frangible portion or portions of the first deformable compartment 3.1 are situated such that, when the frangible portion or portions are broken, the contents of the first deformable compartment 3.1 can flow into the first buffer area 3.11.

The first buffer area 3.11 is more particularly configured to fluidically connect the first deformable compartment 3.1 and the first connecting passage 3.3 when the frangible portion or portions of the first deformable compartment 3.1 are broken. Advantageously, before the rupture of the frangible portion or portions of the first deformable compartment 3.1, the two walls delimiting the first buffer area 3.11 are in contact with one another such that the volume of the first buffer area 3.11 is then substantially null. After the rupture of the frangible portion or portions of the first deformable compartment 3.1, the flowing of the contents from the first deformable compartment 3.1 into the first buffer area 3.11 leads to a separation of the two walls delimiting the first buffer area 3.11, and thus an increase in the volume of the first buffer area 3.11.

The first capsule 3 further comprises an outlet passage 3.5, such as an outlet channel, which is fluidically connected to the first connecting passage 3.3, and which is provided with an outlet orifice 3.6. Advantageously, the outlet passage 3.5 extends in line with the first connecting passage 3.3, and substantially parallel to the first connecting passage 3.3.

According to the embodiment represented in FIGS. 1 to 22, the first capsule 3 comprises a thermoformed shell 3.7 and a sealing leaf 3.8 covering the thermoformed shell 3.7. The thermoformed shell 3.7 and the sealing leaf 3.8 of the first capsule 3 advantageously delimit the first deformable compartment 3.1, the first connecting passage 3.3 and the outlet passage 3.5.

The second capsule 4 comprises a second deformable compartment 4.1 containing the second formulation, a second connecting part 4.2 configured to be connected to the first connecting part 3.2, and a second connecting passage 4.3 configured to fluidically connect the second deformable compartment 4.1 and the second connecting part 4.2. Advantageously, the second connecting passage 4.3 is formed by a second connecting channel, and the second connecting part 4.2 extends substantially perpendicularly with respect to the second connecting passage 4.3. The second connecting part 4.2 comprises more particularly a female connecting end 4.4, which may, for example, have a cylindrical shape, fluidically connected to the second connecting passage 4.3 and configured to receive the male connecting end 3.4 in a tightly sealed manner.

According to the embodiment represented in the figures, the second deformable compartment 4.1 comprises a second frangible peripheral area 4.10, presenting one or more frangible portions, also called weakening portions, configured to break when sufficient mechanical pressure is applied to the second deformable compartment 4.1.

Advantageously, the second capsule 4 also comprises a second buffer area 4.11 extending at least in part around the second peripheral area 4.10 of the second deformable compartment 4.1, and the frangible portion or portions of the second deformable compartment 4.1 are situated such that, when the frangible portion or portions are broken, the contents of the first deformable compartment 4.1 can flow into the first buffer area 4.11.

The second buffer area 4.11 is more particularly configured to fluidically connect the second deformable compartment 4.1 and the second connecting passage 4.3 when the frangible portion or portions of the second deformable compartment 4.1 are broken. Advantageously, before the rupture of the frangible portion or portions of the second deformable compartment 4.1, the two walls delimiting the second buffer area 4.11 are in contact with one another such that the volume of the second buffer area 4.11 is then substantially null.

According to the embodiment represented in FIGS. 1 to 22, the second capsule 4 comprises a thermoformed shell 4.5 and a sealing leaf 4.6 covering the thermoformed shell 4.5. The thermoformed shell 4.5 and the sealing leaf 4.6 of the second capsule 4 advantageously delimit the second deformable compartment 4.1 and the second connecting passage 4.3.

Advantageously and for the reasons mentioned below, both the first and second capsules 3, 4 are configured to contain the totality or substantially the totality of a mixture formed by the predetermined quantity of the first formulation and the predetermined quantity of the second formulation.

As shown more particularly in FIGS. 7 to 14, the receiving device 5 is able to occupy an open position, in which the first and second capsules 3, 4 are able to be inserted into the receiving device 5, and a closed position, in which the receiving device 5 is able to hold the first and second capsules 3, 4 in position.

The receiving device 5 comprises more particularly a receiving enclosure 7 configured to receive and house at least in part the first and second capsules 3, 4. The receiving enclosure 7 comprises in particular a first protective shell 8 and a second protective shell 9 hingedly mounted with respect to one another about a joint axis 10 and between a first position (see FIG. 8) corresponding to an open position of the receiving device 5 and a second position (see FIG. 7) corresponding to a closed position of the receiving device 5. The first and second protective shells 8, 9 may, for example, have a tilt angle of between 50 and 90°, such as a tilt angle of about 70°, when they are in the first position.

The receiving device 5 further comprises a first support part 11 and a second support part 12 arranged in the receiving enclosure 7. The first and second support parts 11, 12 comprise, respectively, a first receiving location 13 configured to receive the first capsule 3 and a second receiving location 14 configured to receive the second capsule 4. Advantageously, the first receiving location 13 comprises a first receiving groove 15 configured to receive a peripheral portion of the first capsule 3, and the second receiving location 14 comprises a second receiving groove (not visible in the figures) configured to receive a peripheral portion of the second capsule 4.

According to the embodiment represented in FIGS. 1 to 22, the first and second support parts 11, 12 are hinged to one another about a joint axis 10 and between a receiving position (see FIGS. 8 and 13) in which the first and second support parts 11, 12 are separated from one another and the first and second capsules 3, 4 are able to be received in the first and second receiving locations 13, 14, respectively, and a connecting position (see FIG. 12) in which the first and second support parts 11, 12 are close to one another and the first and second capsules 3, 4 are able to be connected to one another. The first and second support parts 11, 12 may, for example, have a tilt angle of between 5 and 20°, such as a tilt angle of about 10°, when they are in the receiving position, and be substantially parallel to one another when they are in the connecting position.

Advantageously, the first and second support parts 11, 12 are configured to be moved to the connecting position when the receiving device 5 is moved to the closed position, and thus to connect fluidically the first and second connecting parts 3.2, 4.2 when the receiving device 5 is moved to the closed position.

The first support part 11 further comprises a first foolproofing element 17, such as a first foolproofing notch, configured to cooperate with the first connecting part 3.2 of the first capsule 3, and the second support part 12 comprises a second foolproofing element 18, such as a second foolproofing notch, configured to cooperate with the second connecting part 4.2. The first and second foolproofing elements 17, 18 ensure that the first capsule 3 is positioned only on the first support part 11, and that the second capsule 4 is positioned only on the second support part 12, and thus prevent any error in positioning the first and second capsules 3, 4 in the receiving device 5.

The first and second support parts 11, 12 are more particularly configured such that the first and second capsules 3, 4 extend substantially parallel to one another, when the first and second support parts 11, 12 are in the connecting position.

As shown in FIGS. 7 and 13, the first capsule 3 is configured to extend in part outside of the receiving device 5 when it is received in the receiving device 5 and the latter is in the closed position. Advantageously, the outlet orifice 3.6 is configured to extend outside of the receiving device 5 when the first capsule 3 is received in the receiving device 5 and the latter is in the closed position.

Figure 9:
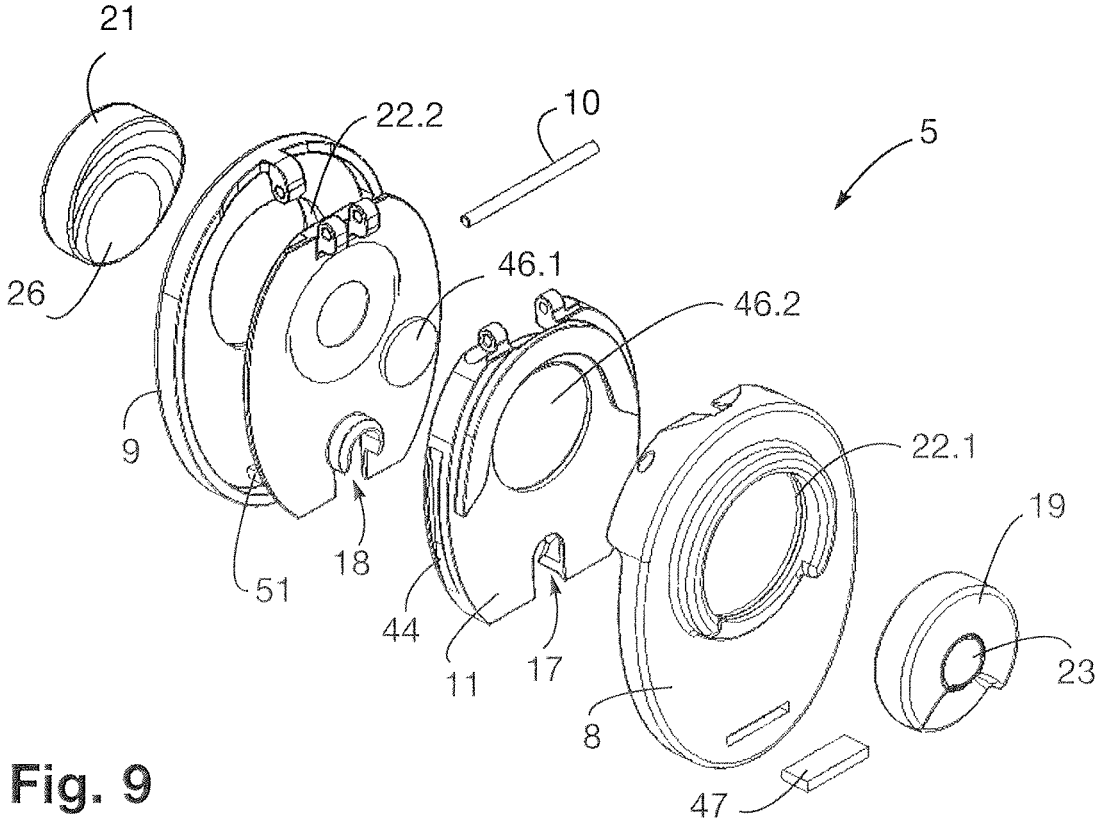
Figure 15:
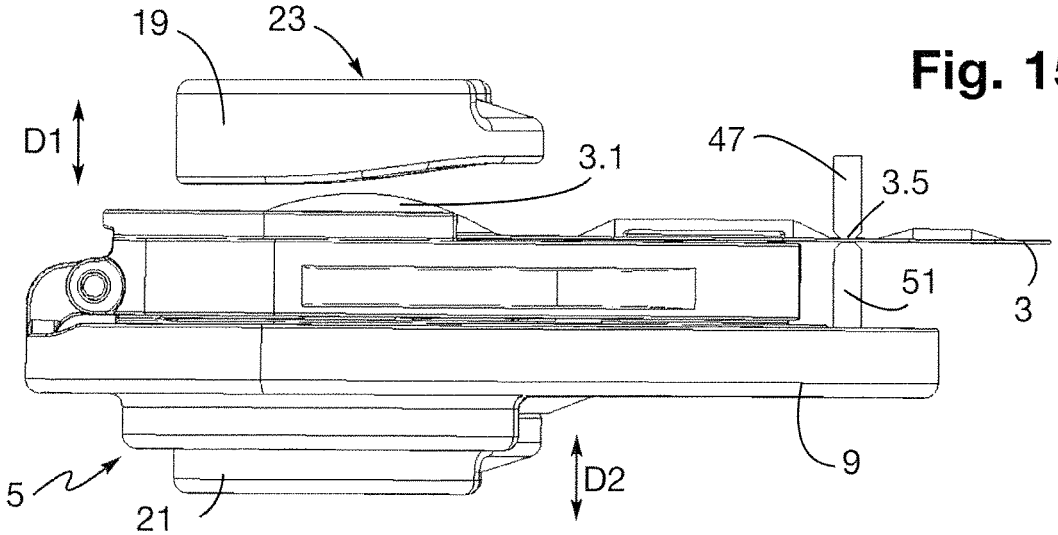
FIGS. 15 and 16 are partial side views of the receiving device in FIG. 7 equipped with the first and second capsules, showing a first bearing element in an inactive position and an active position, respectively.
Figure 16:
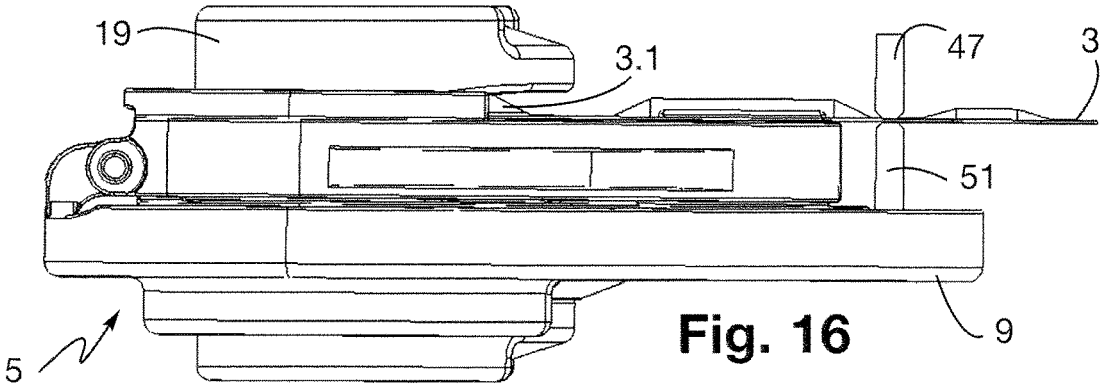
Figure 17:
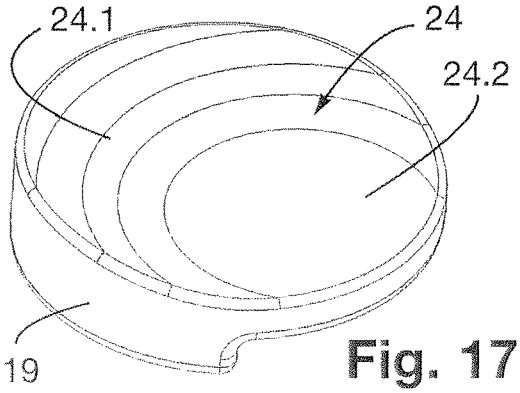
FIGS. 17 and 18 are perspective views of the first and second bearing elements, respectively, of the production apparatus.
Figure 18:
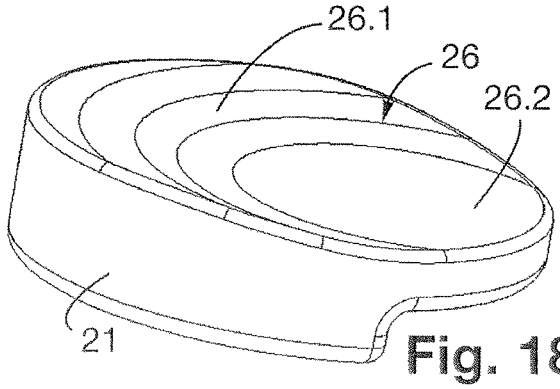
Figure 19:
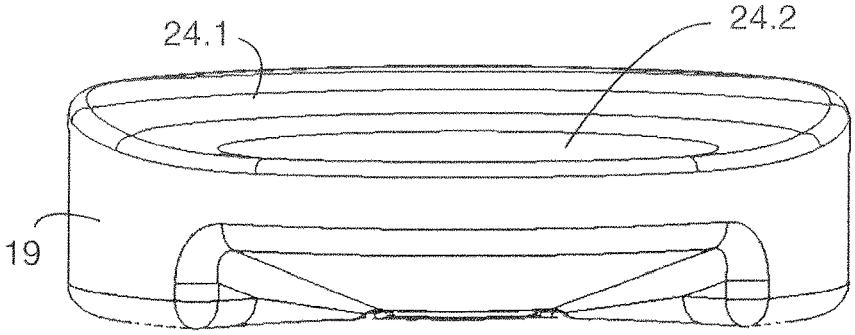
FIG. 19 is a front view of the first bearing element of the production apparatus.

As shown in particular in FIGS. 9, 15 and 16, the receiving device 5 further comprises a first bearing element 19 configured to apply a pressure force on the first capsule 3, and more particularly on the first deformable compartment 3.1, and a second bearing element 21 configured to apply a pressure force on the second capsule 4, and more particularly on the second deformable compartment 4.1.

The first bearing element 19 is mounted on the first protective shell 8 and can be moved between an inactive position (see FIG. 15) and an active position (see FIG. 16) in which the first bearing element 19 is able to apply a pressure force on the first deformable compartment 3.1. The first bearing element 19 may, for example, be mounted such that it can move in translation according to a first direction of movement D1 which is transverse, and preferably substantially orthogonal, to the extension planes of the first and second capsules 3, 4 when the receiving device 5 equipped with the first and second capsules 3, 4 is in the closed position.

According to the embodiment represented in FIGS. 1 to 22, the first bearing element 19 extends through a first through opening 22.1 provided on the first protective shell 8, and comprises a first actuating surface 23 accessible from outside of the receiving device 5, and more specifically from outside of the receiving enclosure 7. The function of the first actuating surface 23 will be defined later.

The first bearing element 19 further comprises a first bearing surface 24 opposite the first actuating surface 23 and extending inside the receiving device 5. The first bearing surface 24 is configured to cooperate with the first deformable compartment 3.1, and to conduct and guide the contents of the first capsule 3 toward the first connecting passage 3.3, when the first bearing element 19 applies a pressure force on the first deformable compartment 3.1.

The first bearing surface 24 comprises a first primary surface portion 24.1 configured to apply a pressure force on a first portion of the first deformable compartment 3.1, and a second primary surface portion 24.2 configured to apply a pressure force on a second portion of the first deformable compartment 3.1 which is closer to the first connecting passage 3.3 than the first portion of the first deformable compartment 3.1. According to the embodiment represented in FIGS. 1 to 22, the first primary surface portion 24.1 is configured to apply, on the first portion of the first deformable compartment 3.1, a pressure force which is oriented obliquely with respect to the first direction of movement D1 and substantially toward the first connecting passage 3.3, and the second primary surface portion 24.2 is configured to apply, on the second portion of the first deformable compartment 3.1, a pressure force which is oriented substantially parallel to the first direction of movement D1, or which is oriented obliquely with respect to the first direction of movement and substantially toward the first connecting passage 3.3.

Advantageously, the first primary surface portion 24.1 is configured to apply a pressure force in particular on a rear part of the first deformable compartment 3.1, that is, a part of the first deformable compartment 3.1 which is opposite the first connecting passage 3.3, and the second primary surface portion 24.2 is configured to apply a pressure force in particular on a front part of the first deformable compartment 3.1, that is, a part of the first deformable compartment 3.1 which is facing the first connecting passage 3.3.

According to the embodiment represented in FIGS. 1 to 22, the first primary surface portion 24.1 is formed by a protuberance, which may be substantially arched, provided on the first bearing element 19, and the second primary surface portion 24.2 is substantially flat, and at least in part surrounded by the first primary surface portion 24.1.

The first and second primary surface portions 24.1, 24.2 are more particularly configured such that, when the first bearing element 19 is moved to the active position, the first primary surface portion 24.1 applies a pressure force on the first compartment 3.1 before the second primary surface portion 24.2 applies a pressure force on the first compartment 3.1.

The second bearing element 21 being identical to the first bearing element 19, the structure and the functioning of the second bearing element 21 are not described in detail below for the sake of brevity.

In particular, the second bearing element 21 extends through a second through opening 22.2 provided on the second protective shell 9, and comprises a second actuating surface 25 accessible from outside of the receiving enclosure 7, and a second bearing surface 26 opposite the second actuating surface 25. The second bearing surface 26 is configured to cooperate with the second deformable compartment 4.1, and to conduct and guide the contents of the second capsule 4 toward the second connecting passage 4.3, when the second bearing element 21 applies a pressure force on the second deformable compartment 4.1.

Advantageously, the second bearing surface 26 also comprises first and second secondary surface portions 26.1, 26.2 configured such that, when the second bearing element 21 is moved to the active position, the first secondary surface portion 26.1 applies a pressure force on the second compartment 4.1 before the second secondary surface portion 26.2 applies a pressure force on the second compartment 4.1.

Advantageously, the first secondary surface portion 26.1 is configured to apply a pressure force in particular on a rear part of the second deformable compartment 4.1, that is, a part of the second deformable compartment 4.1 which is opposite the second connecting passage 4.3, and the second secondary surface portion 26.2 is configured in particular to apply a pressure force on a front part of the second deformable compartment 4.1, that is, a part of the second deformable compartment 4.1 which is facing the second connecting passage 4.3.

In addition, like the first bearing element 19, the second bearing element 21 may also be mounted such that it can move in translation according to a second direction of movement D2 which is transverse, and preferably substantially orthogonal, to the extension planes of the first and second capsules 3, 4 when the receiving device 5 equipped with the first and second capsules 3, 4 is in the closed position.

Both the first and second bearing elements 19, 21 may, for example, be made of an at least partially deformable material, such as silicone.

The receiving device 5 further comprises a locking element (not represented in the figures), such as a locking pin, configured to lock the receiving device 5 in the closed position, and more particularly to lock the first and second protective shells 8, 9 in the second position. Advantageously, the locking element is able to move between a locking position, in which the locking element locks the first and second protective shells 8, 9 in the second position, and an unlocking position, in which the locking element allows the first and second protective shells 8, 9 to be moved to the first position.

Advantageously, the receiving device 5 also comprises a releasing element (not represented in the figures), such as a release button, configured to move the locking element to the unlocking position. Advantageously, the releasing element is able to move between an inactive position and an actuating position, in which the releasing element is able to move the locking element to the unlocking position. Advantageously, the receiving device 5 comprises a biasing element (not represented in the figures) configured to bias the releasing element to the inactive position.

As shown more particularly in FIGS. 20 to 22, the mixing machine 6 comprises a support 31, and a receiving housing 32 defined at least in part by the support 31 and configured to receive at least in part the receiving device 5. According to the embodiment represented in FIGS. 1 to 22, the mixing machine 6 and the receiving device 5 are configured such that the receiving device 5 extends at least in part outside of the mixing machine 6, when the receiving device 5 is received in the receiving housing 32.

The mixing machine 6 also comprises a base 33 in which the support 31 is housed, and an insertion opening 34 leading to the receiving housing 32, the receiving device 5 being configured to be inserted into the receiving housing 32 through the insertion opening 34. Advantageously, the insertion opening 34 is arranged in a central portion of an upper surface of the base 33, and is configured to be facing up when the mixing machine 6 is arranged on a horizontal support surface.

The mixing machine 6 further comprises an actuating part 35 mounted such that it can pivot on the support 31 about a substantially vertical pivot axis 36
when the mixing machine 6 is arranged on a horizontal support surface.

The actuating part 35 comprises a first actuating member 37, such as a first actuating pin, configured to transmit a pressure force to the first capsule 3, and a second actuating member 38, such as a second actuating pin, opposite the first actuating member 37 and configured to transmit a pressure force to the second capsule 4. The first and second actuating members 37, 38 are configured to be arranged on both sides of the receiving device 5 when the latter is received in the mixing machine 6, and more specifically in the receiving housing 32.

The first and second actuating members 37, 38 are more particularly configured to apply pressure forces, respectively and alternatively, on the first and second bearing elements 19, 21, so as to transmit pressure forces, respectively and alternatively, on the first and second compartments 3.1, 4.1. In particular, the first and second actuating members 37, 38 are configured to cooperate, respectively, with the first and second actuating surfaces 23, 25 of the first and second bearing elements 19, 21.

According to the embodiment represented in FIGS. 1 to 22, the first and second actuating members 37, 38 extend substantially in the same extension plane, and converge opposite the pivot axis 36.

The mixing machine 6 also comprises a drive motor 39 mounted on the support 31. The drive motor 39 is configured to make the actuating part 35 pivot about the pivot axis 36 and in a predetermined angular range.

According to the embodiment represented in FIGS. 1 to 22, the mixing machine 6 also comprises a drive wheel 41 non-rotatably fixed with respect to an output shaft of the drive motor 39 and configured to be driven in rotation about its wheel axis and in a direction of rotation by the drive motor 39. The drive wheel 41 is equipped with a drive element 42, such as a catch pin, which is off center in relation to the wheel axis, and which is received in a receiving opening 43 provided on the actuating part 35. Advantageously, the receiving opening 43 is elongated and extends according to a direction of extension substantially parallel to the pivot axis 36. Such a configuration of the mixing machine 6 makes it possible to obtain an alternating movement of the actuating part 35 by making the drive motor 39 always turn in the same direction of rotation, such that it is not necessary to use a costly control system for the drive motor 39.

According to one embodiment variant of the invention, the mixing machine 6 could be configured such that a rotation of the drive motor 39 in a first direction of rotation results in a pivoting of the actuating part 35 in a first pivot direction, and that a rotation of the drive motor 39 in a second direction of rotation, opposite the first direction of rotation, results in a pivoting of the actuating part 35 in a second pivot direction, opposite the first pivot direction.

According to the embodiment represented in FIGS. 1 to 22, the receiving device 5 comprises (see FIG. 20) two primary guide elements 44, such as guide grooves, configured to cooperate, respectively, with secondary guide elements 45, such as guide pins or guide tabs, provided on the mixing machine 6, when the receiving device 5 is received in the mixing machine 6. The primary guide elements 44 may, for example, be provided on the first support part 11, and the secondary guide elements 45 may, for example, be provided on the support 31. The presence of such guide elements facilitates the positioning of the receiving device 5 in the receiving housing 32.

The production apparatus 2 further comprises a heating element 46 configured to heat at least the first capsule 3 when the receiving device 5 equipped with the first and second capsules 3, 4 is received in the mixing machine 6. The heating device 46 may, for example, comprise a resistive heating element 46.1 and a heating plate 46.2 adjacent to the resistive heating element 46.1.

According to one embodiment represented in the figures, the heating element 46 is arranged in the receiving device 5, and is advantageously mounted on the first support part 11 so as to extend between the first and second capsules 3, 4 when the latter are received in the receiving device 5. Preferably, the heating element 46 is arranged to extend close to the first deformable compartment 3.1 and, for example, in contact with the first deformable compartment 3.1. However, according to another embodiment of the invention, the heating element 46 could be arranged inside the mixing machine 6 and could be configured to extend between the first and second capsules 3, 4 when the receiving device 5 equipped with the first and second capsules 3, 4 is received in the mixing machine 6.

According to one embodiment of the invention, the mixing machine 6 also comprises an electrical power source (not represented in the figures) configured to electrically power the mixing machine 6, and in particular the drive motor 39. The electrical power source may, for example, comprise at least one rechargeable battery.

When the heating element 46 is arranged in the receiving device 5, the electrical power source is advantageously also configured to electrically power the receiving device 5, and in particular the heating element 46, when the receiving device 5 is received in the mixing machine 6. For this purpose, the mixing machine 6 comprises a first electrical connector (not represented in the figures), and the receiving device 5 comprises a second electrical connector (not represented in the figures) configured to be connected to the first electrical connector when the receiving device 5 is received in the mixing machine 6, such that the mixing machine 6 is able to electrically power the receiving device 5.

The mixing machine 6 further comprises a controller, which may be provided with a microcontroller, configured to control the functioning of the drive motor 39 and of the heating element 46.

The production apparatus 2 further comprises a sealing element 47 configured to automatically seal the outlet passage 3.5 of the first capsule 3 when the receiving device 5, equipped with the first and second capsules 3, 4, is received in the mixing machine 6, and to automatically release the outlet passage 3.5 when the receiving device 5, equipped with the first and second capsules 3, 4, is removed from the mixing machine 6. Advantageously, the sealing element 47 is configured to apply pressure on a wall of the outlet passage 3.5 so as to seal the latter.

The sealing element 47 may, for example, be mounted such that it can move on the first protective shell 8 between a sealing position (see FIGS. 14 and 15) in which the sealing element 47 is able to seal the outlet passage 3.5, and a releasing position (see FIG. 12) in which the sealing element 47 is able to release the outlet passage 3.5, and the mixing machine 6 may, for example, comprise a movement element 48 configured to move the sealing element 47 to the sealing position when the receiving device 5 is inserted in the mixing machine 6.

According to the embodiment represented in FIGS. 1 to 22, the movement element 48 is mounted such that it is fixed to the support 31 and comprises a movement ramp 49 (see FIG. 14) configured to cooperate with the sealing element 47 and move the latter to the releasing position.

Advantageously, the production apparatus 2 comprises a biasing member (not represented in the figures), configured to bias the sealing element 47 to the releasing position. These provisions ensure automatic movement of the sealing element 47 to the releasing position as soon as the receiving device 5 is removed from the mixing machine 6.

According to the embodiment represented in FIGS. 1 to 22, the production apparatus 2 further comprises a counter-bearing element 51, such as a rib or a counter-bearing tab, configured to lean against the first capsule 3 and to be arranged opposite the sealing element 47 when the receiving device 5, equipped with the first and second capsules 3, 4, is received in the mixing machine 6. Advantageously, the counter-bearing element 51 is provided on the receiving device 5 and, for example, on the second protective shell 9. The presence of such a counter-bearing element ensures optimal pinching of the outlet passage 3.5 when the receiving device 5 is received in the mixing machine 6.

A process for producing a composition, such as a cosmetic product, using the production apparatus 2 will now be described. Such a production process includes the following steps in particular:

- provide the production apparatus 2,
- move the first and second protective shells 8, 9 to the first position,
- move the first and second support parts 11, 12 to the receiving position,
- insert the first and second capsules 3, 4 in the first and second receiving locations 13, 14, respectively,
- move the first and second protective shells 8, 9 to the second position so as to move the first and second support parts 11, 12 to the connecting position, and thus so as to connect the first and second connecting parts 3.2, 4.2,
- insert the receiving device 5 equipped with the first and second capsules 3, 4 in the receiving housing 32 of the mixing machine 6,
- automatically move the sealing element 47 to the sealing position so as to automatically seal the outlet passage 3.5 of the first capsule 3,
- heat the first deformable compartment 3.1 and the first formulation contained in the latter, and
- mix the first and second formulations inside the first and second capsules 3, 4 so as to obtain the cosmetic product.

The mixing step more particularly includes the following steps:

- make the actuating part 35 pivot in the first pivot direction such that the first actuating member 37 applies a pressure force on the first bearing element 19 and moves the latter to the active position; such a movement of the first bearing element 19 leading to an overpressure at the first frangible peripheral area 3.10 of the first deformable compartment 3.1 and thus a rupture of the respective frangible portion or portions, then a flow of the first formulation, contained in the first deformable compartment 3.1, to the second buffer area 4.11 via the first connecting passage 3.3 and the second connecting passage 4.3; such a flow of the first formulation leading to an overpressure at the second frangible peripheral area 4.10 of the second deformable compartment 4.1, and thus a rupture of the respective frangible portion or portions and a penetration of the first formulation in the second deformable compartment 4.1,
- make the actuating part 35 pivot in the second pivot direction such that the second actuating member 38 applies a pressure force on the second bearing element 21, so as to move the latter to the active position and lead the mixture of the first and second formulations contained in the second deformable compartment 4.1 to flow to the first deformable compartment 3.1, and
- make the actuating part 35 pivot successively in the first pivot direction and in the second pivot direction, and repeat such a step several times, for example, 2 to 15 times, and advantageously 5 to 10 times, so as to make the mixture of the first and second formulations pass successively to the first deformable compartment 3.1 and to the second deformable compartment 4.1, in order to obtain a homogeneous mixture of the first and second formulations.

The production process also includes the following steps:

- remove the receiving device 5 from the mixing machine 6,
- automatically move the sealing element 47 to the releasing position so as to automatically release the outlet passage 3.5 of the first capsule 3,
- manually apply a mechanical pressure on the first and second bearing elements 19, 21 so as to expel the cosmetic product produced from the first and second capsules 3, 4 and
- collect, on a user's fingers, for example, the cosmetic product produced.

FIGS. 23 and 24 represent a production apparatus 2 according to a second embodiment of the invention which is different from the one represented in FIGS. 1 to 22, in particular in that the actuating part 35 is mounted such that it can move in translation with respect to the support 31 and is able to occupy a first position, in which the first actuating member 37 is able to apply a pressure force on the first bearing element 19, and a second position in which the second actuating member 38 is able to apply a pressure force on the second bearing element 21, and in that the mixing machine 6 comprises a drive cam 52 non-rotatably fixed with respect to the drive motor 39 and configured to move the actuating part 35 to the first position, and a biasing element 53, such as a helical spring, configured to bias the actuating part 35 to the second position.

As goes without saying, the invention is not limited only to the forms of execution of this production apparatus, described above as examples; on the contrary, it encompasses all embodiment variants. Thus, in particular, the first and second actuating members could be separate and distinct from one another.

The invention claimed is:

1. Production apparatus for producing a composition, comprising:

a receiving device configured to receive first and second capsules comprising, respectively, first and second deformable compartments containing, respectively, a first formulation and a second formulation, a first bearing element comprising a first bearing surface configured to apply a pressure force on the first deformable compartment of the first capsule when the first capsule is received in the receiving device, and a second bearing element comprising a second bearing surface configured to apply a pressure force on the second deformable compartment of the second capsule when the second capsule is received in the receiving device, wherein the first bearing surface is configured to conduct and guide the contents of the first capsule toward a first connecting passage of the first capsule which is able to be fluidically connected to the first deformable compartment, when the first bearing surface applies a pressure force on the first deformable compartment, and wherein the second bearing surface is configured to conduct and guide the contents of the second capsule toward a second connecting passage of the second capsule which is able to be fluidically connected to the second deformable compartment, when the second bearing surface applies a pressure force on the second deformable compartment, and wherein the first connecting passage is fluidically connectable to the second connecting passage when the first and second capsules are received in the receiving device to permit a content of the first capsule to migrate to the second capsule when the first bearing element applies said pressure force on the first deformable compartment, and to permit a content of the second capsule to migrate to the first capsule when the second bearing element applies said pressure force on the second deformable compartment.

2. The production apparatus according to claim 1, wherein the first bearing element is able to move between an inactive position and an active position, in which the first bearing surface is able to apply a pressure force on the first deformable compartment of the first capsule, and the second bearing element is able to move between an inactive position and an active position, in which the second bearing surface is able to apply a pressure force on the second deformable compartment of the second capsule.

3. The production apparatus according to claim 2, wherein the first bearing element is able to move according to a first direction of movement, and the second bearing element is able to move according to a second direction of movement.

4. The production apparatus according to claim 2, wherein, when the first bearing element is moved from the inactive position to the active position, the first bearing surface is configured to apply a pressure force successively on a first portion of the first deformable compartment situated at a first primary distance from the first connecting passage and on a second portion of the first deformable compartment situated at a second primary distance from the first connecting passage, the second primary distance being smaller than the first primary distance, and wherein, when the second bearing element is moved from the inactive position to the active position, the second bearing surface is configured to apply a pressure force successively on a first portion of the second deformable compartment situated at a first secondary distance from the second connecting passage and on a second portion of the second deformable compartment situated at a second secondary distance from the second connecting passage, the second secondary distance being smaller than the first secondary distance.

5. The production apparatus according to claim 4, wherein the first bearing surface comprises a first primary surface portion configured to apply a pressure force on the first portion of the first deformable compartment, and a second primary surface portion configured to apply a pressure force on the second portion of the first deformable compartment, and the second bearing surface comprises a first secondary surface portion configured to apply a pressure force on the first portion of the second deformable compartment, and a second secondary surface portion configured to apply a pressure force on the second portion of the second deformable compartment.

6. The production apparatus according to claim 5, wherein the first primary surface portion is configured to apply a pressure force on the first portion of the first deformable compartment which is oriented obliquely with respect to the first direction of movement and substantially toward the first connecting passage, and the first secondary surface portion is configured to apply a pressure force on the first portion of the second deformable compartment which is oriented obliquely with respect to the second direction of movement and substantially toward the second connecting passage.

7. The production apparatus according to claim 5, wherein the first primary surface portion is configured to apply a pressure force on at least one peripheral part of the first deformable compartment which is opposite the first connecting passage, and the first secondary surface portion is configured to apply a pressure force on at least one peripheral part of the second deformable compartment which is opposite the second connecting passage.

8. The production apparatus according to claim 5, wherein the first bearing element comprises a first protuberance defining the first primary surface portion, and the second bearing element comprises a second protuberance defining the first secondary surface portion.

9. The production apparatus according to claim 5, wherein the first bearing element is able to move according to a first direction of movement, and the second bearing element is able to move according to a second direction of movement, and wherein the second primary surface portion is configured to apply a pressure force on the second portion of the first deformable compartment which is oriented substantially parallel to the first direction of movement or which is oriented obliquely with respect to the first direction of movement, and substantially toward the first connecting passage, and the second secondary surface portion is configured to apply a pressure force on the second portion of the second deformable compartment which is oriented substantially parallel to the second direction of movement or which is oriented obliquely with respect to the second direction of movement and substantially toward the second connecting passage.

10. The production apparatus according to claim 1, wherein the receiving device comprises the first and second bearing elements.

11. The production apparatus according to claim 1, wherein the receiving device is configured to occupy an open position, in which the first and second capsules are able to be inserted into the receiving device, and a closed position, in which the receiving device is able to hold the first and second capsules in position.

12. The production apparatus according to claim 1, further comprising a mixing machine configured to receive the receiving device equipped with the first and second capsules, and to mix the first and second formulations contained in the first and second capsules so as to obtain the composition.

13. The production apparatus according to claim 12, wherein the mixing machine comprises a first actuating member configured to transmit a pressure force to the first bearing element so as to make the content of the first capsule migrate to the second capsule when the receiving device equipped with the first and second capsules is received in the mixing machine, and a second actuating member configured to transmit a pressure force to the second bearing element so as to make the content of the second capsule migrate into the first capsule when the receiving device equipped with the first and second capsules is received in the mixing machine.

14. The production apparatus according to claim 13, wherein the first and second actuating members are configured to transmit alternatively pressure forces to the first and second bearing elements, respectively.

15. The production apparatus according to claim 12, wherein the mixing machine is configured to mix the first and second formulations inside the first and second capsules.

16. The production apparatus according to claim 1, wherein the first bearing element is adapted to move along a first direction that is perpendicular to an extension plane of the first capsule to apply said pressure force on the first deformable compartment of the first capsule when the first capsule is received in the receiving device, and wherein the first bearing surface includes a first primary surface that is shaped such that a force vector exerted by the first primary surface on the first capsule when the first bearing element moves along said first direction and applies said pressure force on the deformable component, presents a positive, non-zero component in a direction of the first connecting passage.

* * * * *